United States Patent [19]

Sears et al.

[11] Patent Number: 4,919,592

[45] Date of Patent: Apr. 24, 1990

[54] RADIALLY COMPACT FLUID COMPRESSOR

[75] Inventors: Stephan B. Sears; Dan M. Pomeroy, both of Menlo Park, Calif.

[73] Assignee: Superstill Technology, Inc., Redwood City, Calif.

[21] Appl. No.: 298,552

[22] Filed: Jan. 18, 1989

[51] Int. Cl.[5] ..... F04D 29/42

[52] U.S. Cl. ..... 415/207

[58] Field of Search ..... 415/203, 204, 206, 207, 415/225

[56] References Cited

U.S. PATENT DOCUMENTS

| | | | |
|---|---|---|---|
| 2,298,423 | 7/1942 | Funk | 415/206 |
| 3,319,573 | 5/1967 | Judd | 415/206 |
| 4,448,573 | 5/1984 | Franz | 415/206 |

FOREIGN PATENT DOCUMENTS

| | | | |
|---|---|---|---|
| 21608 | 2/1979 | Japan | 415/206 |
| 145497 | 7/1985 | Japan | 415/206 |

*Primary Examiner*—Robert E. Garrett
*Assistant Examiner*—John T. Kwon
*Attorney, Agent, or Firm*—Flehr, Hohbach, Test, Albritton & Herbert

[57] ABSTRACT

The radially compact fluid compressor especially suitable for use in the distillation apparatus or other environments where space may be at a premium is disclosed herein. The compressor includes a power driven impeller and a compressor housing which surrounds the impeller and which together with the impeller defines a fluid collection chamber extending between the first upstream end and a second fluid exiting downstream end. This collection chamber progressively enlarges vertically from its upstream end to its fluid exiting downsteam end, whereby fluid passing through the collection chamber from its upstream end to its downstream end progressively decreases in velocity and therefore progressively increases in static pressure.

1 Claim, 4 Drawing Sheets

RADIALLY COMPACT FLUID COMPRESSOR

The present invention relates generally to fluid compressors and more particularly to the specifically designed, compact fluid compressor of the centrifugal type, and specifically one which is especially suitable for use in a distillation apparatus or in other environments where space may be at a premium.

FIGS. 1 and 2 herein diagrammatically illustrate the typical prior art centrifugal type of fluid compressor which is generally indicated by the reference numeral 10. Compressor 10 includes an impeller assembly 12 and a compressor housing 14. Impeller assembly 12, in turn, includes a horizontally extending impeller 16 having an outermost edge 18 which defines an outermost horizontal circumferential path of movement, and a suitably powered motor 20 for rotating the impeller in a given direction in order to drive its outermost edge through the circumferential path. The compressor housing 14 surrounds the impeller and together with the impeller defines a flow channel or fluid collection chamber 22 in the form of a spiral or volute extending circumferrentially between a first upstream end 24 and a second fluid exiting downstream end or output port 26 which serves as the entry to a diffuser 28.

Overall compressor 10 functions in the following manner to compress fluid, for example steam, which is depicted by arrows 30 in FIGS. 1 and 2. For purposes of discussion only, it will be assumed that the fluid is steam. The steam enters the flow channel or collection chamber initially along on the axis of impeller 18. As it does so, the impeller is rotated, for example, in the clockwise direction as viewed in FIG. 1 and preferably at a constant speed. This causes the steam to move through the collection chamber in the clockwise direction until it ultimately exits the chamber at output port end 26 where it enters the diffuser 28. In order to compress the steam, that is, increase its static pressure, its velocity must be decreased after exiting the impeller or collector. This is accomplished by progressively increasing the area of chamber 22 from its upstream end 24 to its downstream port 26 and in the diffuser 28. In the typical compressor of the prior art, this is accomplished by progressively increasing the outer horizontal dimension of the collection chamber, that is, the outer wall of housing 14. FIGS. 1 and 2 illustrate this. Note specifically that the height of collection chamber 22 is constant (H1) throughout the chamber. On the other hand, its radially or horizontally outward dimension progressively increases. This is diagrammatically represented by the radial dimensions R1 and R2. Note that R1 is less than R2.

While the arrangement of the type illustrated in FIGS. 1 and 2 may operate in a perfectly satisfactory manner as a compressor, the compressor housing must extend, radially or horizontally outward a relatively large distance beyond the outermost edge of its impeller, thereby taking up space in that direction. It is a primary object of the present invention to minimize the requirement for this radially or horizontally outward expansion of the compressor housing without compromising the way in which the compressor functions.

As will be described in more detail hereinafter, the compressor disclosed herein utilizes a flow channel or collection chamber designed to progressively enlarge vertically or axially, that is, in the direction above and/or below the impeller, not radially or horizontally outward. In an actual, preferred embodiment of the present invention, the collection chamber progressively enlarges vertically below the impeller and also radially or horizontally inward below the impeller, thereby maximizing the space both horizontally and vertically.

The compressor disclosed herein will be described in more detail hereinafter in conjunction with the drawings, wherein.

Figure 1:
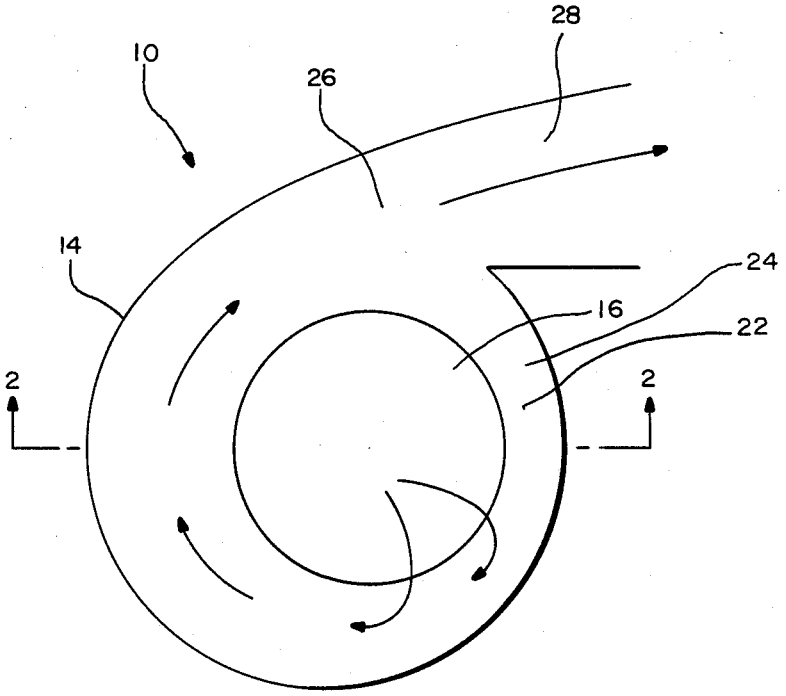
( PRIOR ART ) FIG.—1
FIG. 1 is a diagrammatic illustration, in plan view, of a centrifugal of fluid compressor designed in accordance with the prior art.
Figure 2:
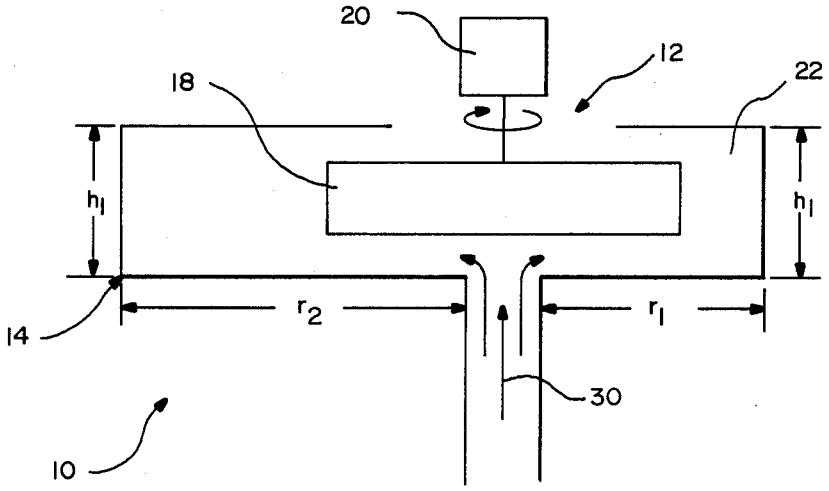
( PRIOR ART ) FIG.—2
FIG. 2 is a sectional view of the compressor of FIG. 1, taken generally along line 2—2 of FIG. 1.
Figure 3:
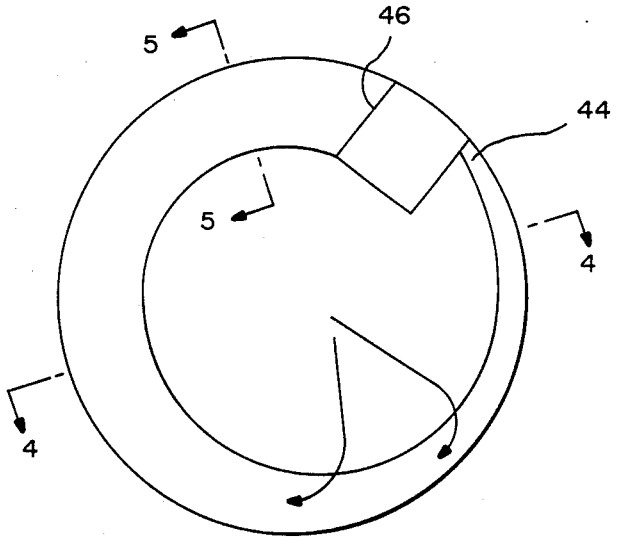
FIG. 3 is a diagrammatic illustration, in plan view, of a centrifugal type of fluid compressor designed in accordance with the present invention.
Figure 4:
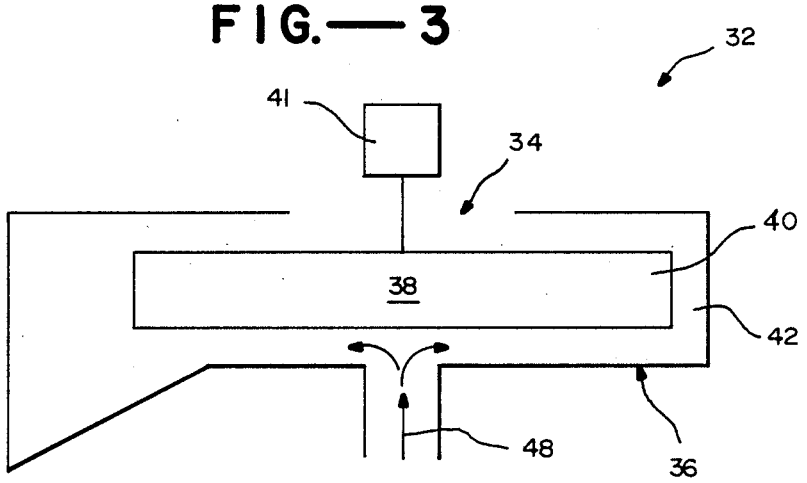
FIG. 4 is a sectional view of the compressor depicted in FIG. 3, taken generally along line 4—4 in FIG. 3.
Figure 5:
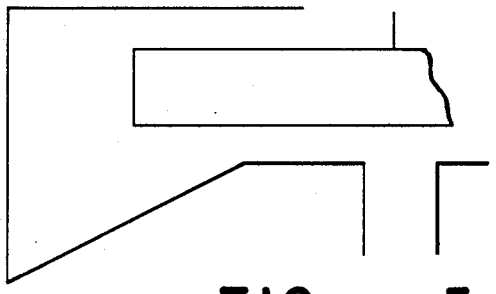
FIG. 5 is another sectional view of the compressor depicted in FIG. 3, taken generally along line 5—5 in FIG. 3.
Figure 6:
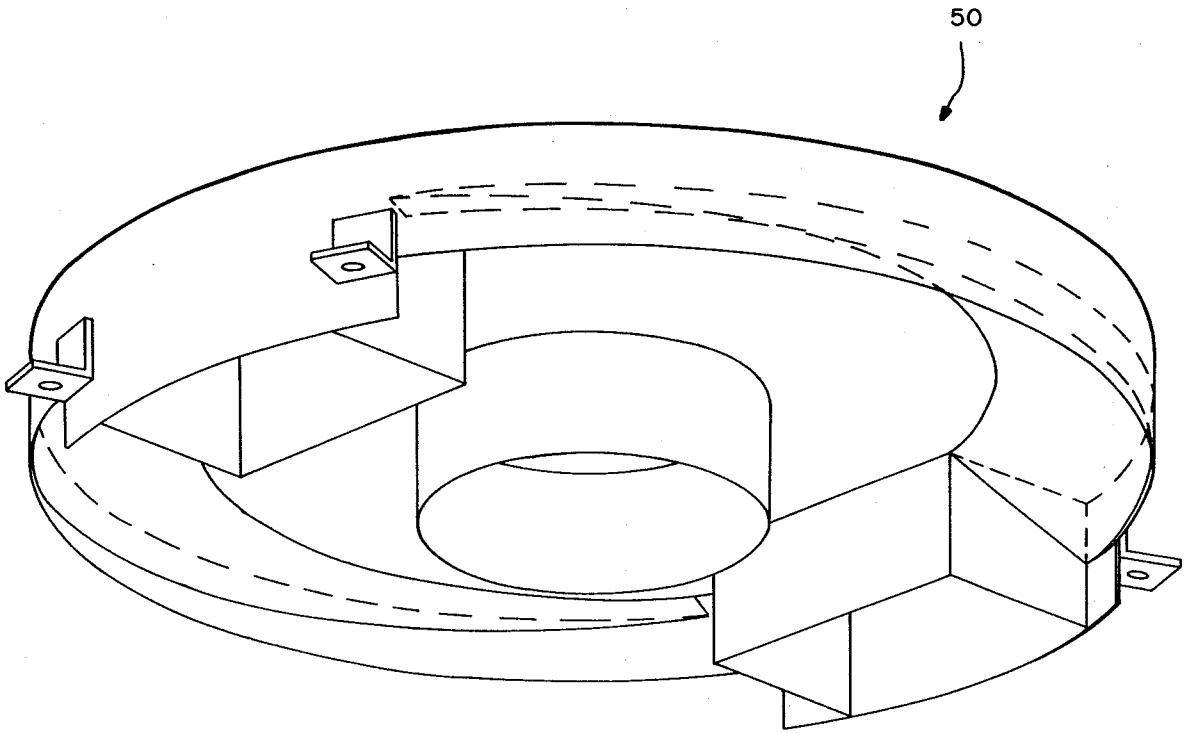
FIG. 6 is a perspective view of the underside of a compressor housing forming part of an actual working compressor designed in accordance with the present invention.
Figure 7:
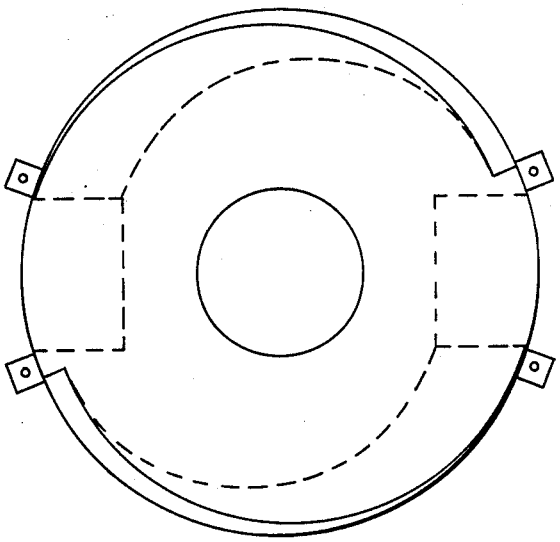
FIG. 7 is a plan view of the compressor housing of FIG. 6.
Figure 8:
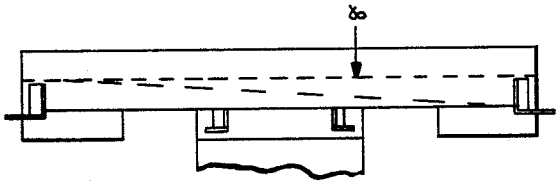
FIG. 8 is a side elevational view of the compressor housing of FIG. 6.
Figure 9:
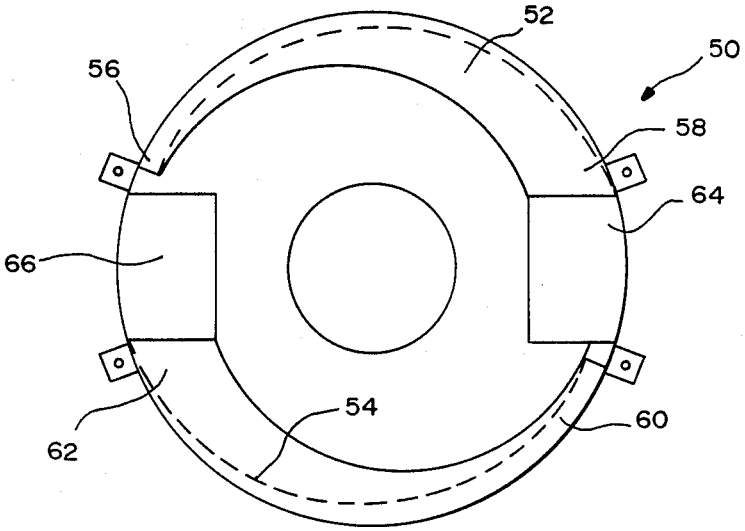
FIG. 9 is a bottom (underside) plan view of the compressor housing of FIG. 6.

Inasmuch as FIGS. 1 and 2 were discussed previously, attention is directed immediately to FIGS. 3-5 which diagrammatically illustrate a centrifugal type of fluid compressor 32 designed in accordance with the present invention. Like the previously described compressor, compressor impeller 38 includes an impeller assembly 34 and a compressor housing 36. Impeller assembly 34, in turn, includes a horizontally extending impeller 38 having an outermost edge 40 which defines an outermost horizontal circumferential movement, and a suitably powered motor 41 for rotating the impeller at a constant speed and in one direction so as to drive its outermost edge through the circumferential path. Compressor housing 36 surrounds the impeller and, together with the impeller, defines a fluid flow channel or collection chamber 42 extending from a first upstream end 44 to a second, fluid exiting downstream end or output port 46 where the fluid passes into a cooperating diffuser or the like.

Overall compressor 32 functions in the same manner as previously described compressor 10. That is, fluid, for example steam as indicated by the arrows 48, enters the collection chamber while impeller 38 is rotated in, for example, the clockwise direction, as viewed in FIG. 3. This causes the steam to flow through the collection chamber in the same direction, that is, clockwise, so that it is ultimately passes out of the chamber at its output port.

In accordance with the present invention, in order to progressively decrease the velocity of the steam as it passes through collection chamber, 42, thereby progressively increasing its static pressure, the collection chamber is progressively enlarged vertically from its upstream end to its downstream end. In the particular embodiment illustrated, the collection chamber is progressively enlarged vertically downward below impeller 38 and radially or horizontally inward. This is best exemplified by the two sectional views taken in FIG. 3. Note specifically in FIG. 4 that the left side of the collection chamber which is downstream from the right side of the chamber as viewed in that figure extends further downward and enlarges inward. Note in FIG. 5 that a still further downstream section enlarges to a greater extent downward and inward. Finally, note that the radially or horizontally outward dimension of the collection chamber remains constant with respect to the outermost edge 40 of impeller 38.

Thus, the maximum radial or horizontal dimensions of overall 32 can be minimized. Moreover, because collection chamber 42 enlarges vertically beyond the impeller, downward in the embodiment shown, the fluid inlets and outlets can be located under the compressor where, for example, they can be easily sealed to a manifold (not shown) using suitable gaskets (also not shown). While it is preferable to enlarge the collection chamber vertically downward for this reason, it is within the scope of the present invention to enlarge it upward. In this regard, it should be understood that the reference to the "vertical" and "horizontal" directions are for purposes of clarity only. The orientation of the overall compressor is not critical to the present invention.

Turning to FIGS. 6–9, a compressor housing generally indicated at 50 is illustrated. This housing forms part of an actual, preferred, centrifugal compressor designed in accordance with the present invention. The compressor itself operates in the same manner as previously described compressors 10 and 32. However, housing 50 together with its impeller (not shown) defines two chambers 52 and 54 circumferrentially spaced apart 180°. Collection chamber 52 extends from an upstream end 56 to a downstream end 58 while collection chamber 54 extends from an upstream end 60 to a downstream end 62. Fluid entering collection chamber 52 passes out its downstream end through outlet 64 which is positioned adjacent the upstream end of chamber 54. Fluid entering chamber 54 passes out an outlet 66 which is adjacent the upstream end 56 of collection chamber 52. Thus, collection housing 50 provides for two collection chambers. Each chamber enlarges vertically downward and radially inward below its impeller in a spiralling fashion, as illustrated in FIGS. 6–9.

What is claimed:

1. A centrifugal type of fluid compressor, comprising:

an impeller assembly including a horizontally extending impeller having an outermost edge defining an outermost horizontal, circumferential path of movement and means for rotating said impeller in a given direction so as to drive its outermost edge through said circumferential path, and a compressor housing surrounding said impeller and together with the impeller defining a fluid collection chamber extending between a first upstream end and a second fluid exiting downstream end, said collection chamber progressively enlarging vertically from its upstream end to its downstream end, whereby fluid passing through said collection chamber from its upstream end to its downstream end progressively decreases in velocity and therefore progressively increases in static pressure, wherein said collection chamber does not enlarge horizontally outward relative to said outermost horizontal path of movement of said impeller at any point between its entry and exit end, whereby to minimize the maximum horizontal dimensions of the overall compression housing, wherein said collection chamber as it approaches its downstream exit end includes a section which extends vertically beyond said impeller, wherein said section of said collection chamber extending vertically beyond said impeller includes a segment thereof extending horizontally inward of said impeller, wherein said collection chamber defines a downwardly and inwardly spiralling path from its upstream end to its downstream exit end, wherein said upstream and downstream ends of said collection chamber are spaced about 180 degrees from one another about said outmost circumferential path of said impeller, wherein said collection chamber extends between said ends on one side of said path and wherein said compressor housing and said impeller together define a second substantially identical collection chamber on the opposite side of said path, between said ends, said second collection chamber spiralling downwardly and inwardly from said downstream end to said upstream end, whereby the upstream end of one collection chamber serves as the downstream end of the other and vice versa.

* * * * *